US005983929A

United States Patent [19]

Andersson

[11] Patent Number: 5,983,929

[45] Date of Patent: Nov. 16, 1999

[54] AIR VALVE

[75] Inventor: Björn Andersson, Bromma, Sweden

[73] Assignee: AB Durgo, Solna, Sweden

[21] Appl. No.: 09/035,878

[22] Filed: Mar. 6, 1998

[30] Foreign Application Priority Data

Mar. 7, 1997 [SE] Sweden ..... 9700819

[51] Int. Cl.[6] ..... F16K 24/00

[52] U.S. Cl. ..... 137/526; 137/216.2; 137/533.31

[58] Field of Search ..... 137/216.2, 526, 137/533.31

[56] References Cited

U.S. PATENT DOCUMENTS 3,923,081 12/1975 Persson ..... 137/526 X 4,436,107 3/1984 Persson ..... 137/526 X

*Primary Examiner*—Gerald A. Michalsky

*Attorney, Agent, or Firm*—Jacobson, Price, Holman & Stern, PLLC

[57] ABSTRACT

An air valve that comprises a concave, downwardly facing cover (4) which is carried by a pipe connector (1) connected generally coaxially thereto, wherein the upper edge-part of the pipe connector (1) is surrounded by the wall of the cover (4), a ring-shaped, upwardly facing first seat ridge (8) which is carried by and sealingly connected to the cover wall (5), a second ring-shaped seat ring (2) which is generally coaxial with the cover wall (5) and is carried by and sealingly connected to the upper end-part of the pipe connector (1), and a valve plate (11) which is vertically movable in the cover (4) and which carries an annular, rubber-elastic valve washer (20) that can rest sealingly on the first and the second seat ridges (8, 2) so as to bridge an annular air through-gap between the seat ridges. Both main surfaces of the valve washer (20) have a surface roughness which is adapted to substantially avoid strain in the outer layers of said main surfaces.

11 Claims, 1 Drawing Sheet

AIR VALVE

BACKGROUND OF THE INVENTION

1. Field of the Invention

The present invention relates to an air valve having a cover that is carried by a pipe connector connected generally coaxially thereto such that the upper part of the pipe connector is surrounded by the wall of the cover, a first ring-shaped seat ridge carried by and sealingly connected to the cover wall, a second ring-shaped seat ridge generally coaxial with the cover wall and sealingly connected to the upper part of the pipe connector, and a valve plate vertically movable in the cover and carrying an annular, valve washer.

2. Description of the Related Art

Air valves are well known and can be fitted to the upper end of a waste pipe, or soil pipe, to which water closets, baths, wash basins, kitchen sinks, etc. can be connected via a so-called water seal. The air valve will normally close when the pressure in the pipe to which the valve is connected is the same as the pressure outside the pipe. The valve shall also seal the pipe channel effectively when the pressure in the pipe is higher than the ambient pressure. When the pressure in the pipe is lower than the ambient pressure, however, the valve will open and allow ambient air to enter so as to equalize the subpressure. This prevents the liquid in the water-seal being sucked away therefrom, which would then allow the waste gases to pass freely into the rooms and spaces in which the water-seal was installed. When fitted to a waste pipe, the air valve will also prevent odors and warm and moist air from flowing out from the upper end of the waste pipe, which enables installation of the sewerage system to be terminated indoors.

Valves of this particular kind will normally include a vertically movable valve plate which carries on its underside an annular sealing washer whose radially inner and outer edge-parts are able to rest sealingly onto concentrical, upwardly facing valve-seat rings, wherewith the washer seals the annular gap between said ring seats. The valve washer normally rests on the seats under the influence of the combined weight of the sealing washer and the guided plate carrying the washer. The valve can be made to open in response to relatively small pressure differences, by ensuring that it is light in weight. The valve is then also able to open very quickly, even after having been in a sealing mode for a relatively long period of time, particularly because the low contact force reduces the tendency of the washer to stick.

The sealing washer must be thin and essentially flat in order to ensure effective sealing abutment with the ring-shaped seats at a low abutment force.

SUMMARY OF THE INVENTION

An object of the present invention is therefore to provide an air valve that includes a sealing washer which provides an effective sealing function at low contact pressures and which also enables the valve to open quickly and easily.

This object is achieved with a sealing washer having roughened upper and lower surfaces, the roughened lower surface acting in conjunction with moisture to form a seal with the first and second seat ridges so as to bridge the ring-shaped air-through gap between the seat ridges.

Conventional sealing washers are produced with smooth main surfaces, so as to provide sealing contact with the valve seat ridges or spines. However, one problem in this regard is that the sealing effect of the sealing washers is quickly lost or impaired if the smooth surfaces of the washers become scratched. Another problem is that the sealing washers readily stick together and to smooth underlying surfaces, after having been removed from the forming tool. The washers are subjected to linear stress or stretch when separated from one another and this stretch often remains to some extent and therewith prevents the washers from lying completely flat, meaning that the valve will not be completely tight in a closed state under the action of the small contact force. Despite very careful handling of the sealing washers in all stages from the manufacture of the washers to finally fitting the washers, far too many washers must be scrapped in order to ensure a peaceful night's sleep on the part of the manufacturer. It should be noted in this respect that biasing the movable sealing washer (the valve plate) towards the valve seat with the aid of spring means will not provide a solution to this problem, since the valve will then need to overcome a greater opening resistance and significant inertia and also a sticking tendency that makes opening of the valve difficult.

In accordance with the invention, it has been found that these problems do not arise when the sealing washer is given a uniform surface roughness such that the washers will no longer be able to stick together or to any other underlying surface.

It was also found, in accordance with the invention, that the washer obtains a very flat form due to this surface roughness, when the roughness is spread over both main surfaces. It would seem that the roughness of the main surfaces of the washer avoided states of compressive stress that would otherwise occur in the outer layers of the washer if the washer surfaces were smooth. A spontaneous conclusion is that the roughness of the sealing surface of the washer would spoil its sealing function precisely because of the roughness of the surface. We found, however, that the sealing washer in this particular application could be given an improved sealing effect by careful selection of the degree of roughness. This is achieved by virtue of the co-action of the surface roughness with the moisture that is found naturally in the gases in the sewerage system against which the sealing washer shall seal. The surface roughness forms a grid-like pattern where the crests of the grid lie against the ridge of the seat, provided that the sealing washer is flat and pliable. The troughs of the grid-like pattern around the crests, form narrow passageways that are sufficiently large for dry air to pass therethrough, but too narrow for liquid to pass at those pressure differences applicable in this context. However, the air and the gases in the waste-water system have a high moisture content. It follows from this that the moisture present in the air will settle on the walls of these passageways in the form of droplets or condensation, and there function as the conclusive seal between the sealing washer and the valve ridge. Any moisture that vaporizes will be replaced immediately with fresh moisture.

When the pressure increases in the sewerage system, the sealing washer will be pressed harder against the seat ridge, so as to reduce the area of the passageways in the elastic sealing washer and therewith enable the seal to withstand this high pressure. High pressure periods are of short duration (seconds and parts thereof) and mostly occur, as a rule, at the commencement of a WC-flushing phase, and followed by subpressure periods. Because the crests of the rough surface are pressed together (massaged) at this high pressure, the valve is able to open and allow air to enter the system more easily upon the occurrence of a subpressure.

It has been found possible to give the washer a relatively slight surface roughness of, e.g., 6 Ra2 (according to AGIEstandards) in the outer and inner edge regions of the washer, i.e. in the washer regions that co-act with the seat ridges. It has also been found that the sealing washer can be given beneficially a coarser surface roughness in its intermediate annular region, for instance a roughness of 9 Ra8 according to the same standard.

One advantageous effect that is obtained when the inventive sealing washer has a coarser roughness in a radial intermediate region is that this region of coarser roughness provides some form of "hinge means" between the radially separated edge-parts of the sealing washer, so as to enable these edge-parts, when seen in an axial plane to the sealing washer, to be angled in relation to each other while generally retaining the straightness of said parts, therewith affording more effective/tighter contact between the ring-shaped seats and the corresponding abutment parts of the sealing washer.

The invention will now be described in more detail with reference to an exemplifying embodiment thereof and also with reference to the accompanying drawing.

DETAILED DESCRIPTION OF THE PREFERRED EMBODIMENTS

Figure 1:
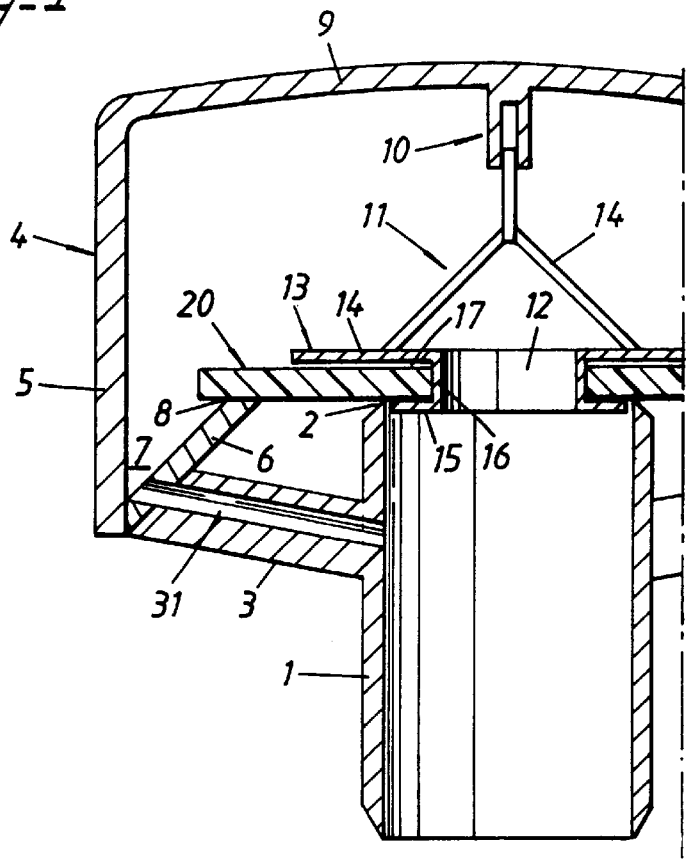
FIG. 1 is a schematic, axial sectioned view of an air valve that includes an inventive sealing washer or disk.

The air valve includes a vertically positioned pipe connector 1 whose upper end forms a valve seat in the form of a ring-shaped, horizontal sealing ridge 2. The pipe connector 1 includes one or more generally radial arms 3 which support a cover 4 whose wall or mantle 5 surrounds the upper end-part of the pipe connector 1. The bottom edge-part of a ring-shaped, conical element 6 is tightly connected to the bottom edge of the cover wall 5, so as to form an annular trough 7. The bottom part of the trough 7 is preferably connected to the interior of the pipe connector 1 by means of a passageway 31 leading to the interior of the pipe connector 1. The passageway 31 can extend through one of the arms 3 and is conveniently sloped downwards towards said pipe connector.

Condensation that forms on the inner surface of the cover 4 can be caught in the trough 7 and run back to the interior of the pipe connector 1.

The upper edge-part of the conical element 6 has a smaller diameter than the lower edge-part and forms a ring-shaped, horizontal sealing ridge 8 that lies in the same horizontal plane as the sealing ridge 2 on the pipe connector 1. Provided on the inner surface of the bottom wall 9 of the cover 4 is a central guide 10 which co-acts with a valve plate 11 such as to enable the valve plate to move linearly in the axial direction of the valve, this direction normally coinciding with the axis of the cover 4 and of the pipe connector 1. The valve plate 11 has a central bore 12 and carries a ring-fitting 13 through the medium of separate arms 14. The ring-fitting 13 may have a U-shaped cross-section with radially and outwardly extending legs 14, 15 that extend from a center ring 16 to form a pocket 17 that receives the inner edge-part of an annular, rubber-elastic sealing washer 20.

The diameter of the ring-shaped bottom leg 15 of the fitting 13 is smaller than the diameter of the pipe connector 1, and the upper leg 14 of the fitting extends to the region between the seat ridges 2 and 8. The bottom leg 15 of the fitting is received inwardly of the inner wall of the pipe connector 1. The main surfaces of the washer or disc 20 have over substantially the whole of their respective areas a degree of roughness that is at least sufficiently coarse to prevent the washers from sticking together or to any other underlying surface, at least to a substantial extent.

Figure 2:
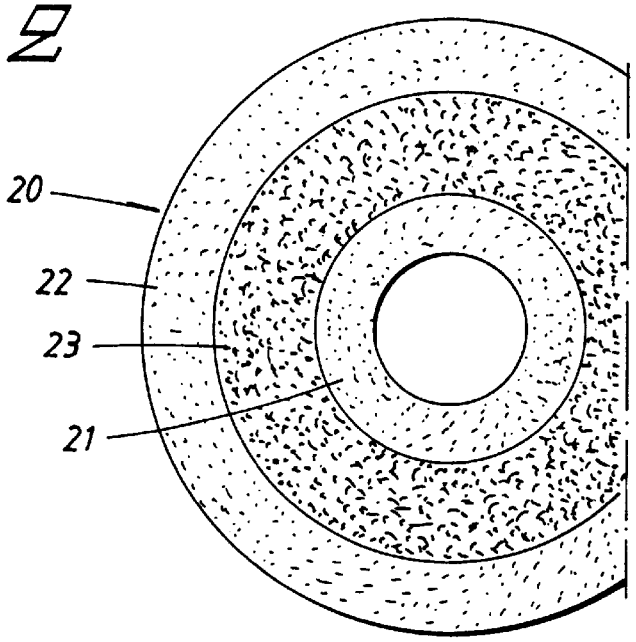
FIG. 2 illustrates the sealing washer in the valve shown in FIG. 1 schematically and from beneath.

As will be evident from FIG. 2, that side of the disc or washer 20 that faces towards the seat ridges 2, 8 has been given a relatively slight roughness in the order of, e.g., 6 Ra2 in the inner edge-region 21 where the washer is able to co-act with the seat ridge 2, and also in the outer annular edge-part 22 where the washer is able to co-act with the seat ridge 8. The washer 20 has been given a coarser roughness of, e.g., 9 Ra8 in the intermediate, annular region 23 of said washer. Liquid present in the contact area between the washer 20 and the seat ridges 2, 8 will ensure that a good seal is achieved. It will be understood that the liquid concerned may be water, i.e. condensation of air-carried moisture, particularly condensation from the normally relatively warm and moist air present within the cover and within the pipe connector 1.

It will be understood that the invention is not limited to the specific embodiment described above, which is the embodiment preferred at present.

For instance, it will be evident that the washer 20 need not have the same degree of roughness on both main surfaces. Furthermore, liquid in the form of a film of oil, e.g. silicone oil, that retains its viscosity over long periods of time and that will remain on the washer for a long period of time while essentially retaining its properties can be applied to the washer, at least to its sealing regions. This oil can serve to preserve the material from which the sealing washer is made and also the properties of the washer. The oil can also provide the aforesaid sealing function. If no oil is present or if oil is present in an insufficient amount, the oil can be supplemented by or replaced with condensation, i.e. essentially water from the gas (the air) with which the air valve is in contact.

The skilled person will realize that the air valve will close in response to a relative overpressure in the cover 4 and in the pipe connector 1, this pressure being able to act on the valve washer 20 so as to bend the washer down between the seat ridges 8 and 2, as seen in FIG. 1, wherewith the intermediate region 23 of coarser roughness functions readily as a hinge means that provides more favorable sealing conditions for the inner and outer edge parts 21, 22 of the washer 20.

The washer region 23 may adjoin the regions 21, 22 directly, so as to enable liquid to migrate freely therebetween.

I claim:

1. An air valve which comprises a concave, downwardly facing cover that is carried by a pipe connector connected generally coaxially thereto, wherein an upper end-part of the pipe connector is surrounded by a wall of the cover, a ring-shaped, upwardly facing first seat ridge which is carried by and sealingly connected to the cover wall, a second ring-shaped seat ridge which is generally coaxial with the cover wall and is carried by and sealingly connected to the upper end-part of the pipe connector, and a valve plate which is vertically movable in the cover and which carries an annular, rubber-elastic valve washer having a roughened upper surface and a roughened lower surface, the roughened lower surface acting in conjunction with moisture to form a seal with the first and the second seat ridges so as to bridge a ring-shaped air through-gap between the seat ridges.

2. The valve according to claim 1, wherein the roughened lower surface of said valve washer has in first and second annular regions that co-act with said first and said second seat ridges, respectively, a degree of roughness that is substantially slighter than a degree of roughness established in a third annular region located between said first and said second annular regions.

3. The valve according to claim 1, wherein the roughened lower surface of the valve washer has a roughness of at least Ra1.

4. The valve according to claim 1, wherein first and second annular regions of the lower surface of said valve washer that co-act with the first and second seat ridges, respectively, have a roughness of about 6 Ra2, and a third annular region lying between said first and second annular regions has a roughness of about 9 Ra8.

5. An air valve for a sewerage system which comprises a concave, downwardly facing cover that is carried by a pipe connector connected generally coaxially thereto, an upper end-part of the pipe connector surrounded by a wall of the cover, a ring-shaped, upwardly facing first seat ridge carried by and sealingly connected to the cover wall, a second ring-shaped seat ridge generally coaxial with the cover wall and carried by and sealingly connected to said pipe connector upper end-part, a valve plate vertically movable in the cover, and an annular rubber-elastic valve washer carried on the valve plate, said valve washer having a roughened lower surface, the roughened lower surface having, in first and second annular regions that co-act with said first and said second seat ridges, respectively, a degree of roughness less than a degree of roughness established in a third annular region located between said first and said second annular regions.

6. The air valve according to claim 5, said valve washer also having a roughened upper surface, the roughened upper surface and the roughened lower surface protecting said washer from linear strain by reducing adherence between said washer and other surfaces.

7. The air valve according to claim 5, wherein said first and second annular regions have a roughness of at least Ra1.

8. The air valve according to claim 5, wherein said first and second annular regions have a roughness of about 6 Ra2, and said third annular region has a roughness of about 9 Ra8.

9. The air valve according to claim 5, wherein the roughened lower surface forms a grid-like pattern having crests and troughs, the crests lying against the seat ridges and the troughs forming narrow passageways large enough for air to pass therethrough but too narrow for liquid to pass therethrough at pressure differences applicable to sewerage systems.

10. A valve disk for use in an air valve for a sewerage system, the air valve having a concave, downwardly facing cover that is carried by a pipe connector connected generally coaxially thereto, wherein an upper end of the pipe connector is surrounded by a wall of the cover, a ring-shaped, upwardly facing first seat ridge which is carried by and sealingly connected to the cover wall, a second ring-shaped seat ridge which is generally coaxial with the cover wall and is carried by and sealingly connected to the upper end of the pipe connector, and a valve plate which is vertically movable in the cover, said valve disk comprising:

an annular, rubber-elastic valve washer carried on the valve plate, said washer having a roughened upper surface and a roughened lower surface, the roughened lower surface acting in conjunction with moisture inherent in the sewerage system to form a seal with the first and the second seat ridges so as to bridge a ring-shaped air through-gap between the seat ridges.

11. The valve disk as set forth in claim 10, wherein the roughened lower surface of said valve washer has in first and second annular regions that co-act with said first and said second seat ridges, respectively, a degree of roughness that is less than a degree of roughness established in a third annular region located between said first and said second annular regions.

* * * * *